US008240862B1

(12) United States Patent
Newhouse

(10) Patent No.: US 8,240,862 B1
(45) Date of Patent: Aug. 14, 2012

(54) TASK LIGHT

(75) Inventor: Thomas James Newhouse, Grand Rapids, MI (US)

(73) Assignee: Thomas J. Newhouse-Design, Grand Rapids, MI (US)

( * ) Notice: Subject to any disclaimer, the term of this patent is extended or adjusted under 35 U.S.C. 154(b) by 338 days.

(21) Appl. No.: 12/647,990

(22) Filed: Dec. 28, 2009

Related U.S. Application Data

(60) Provisional application No. 61/145,559, filed on Jan. 18, 2009.

(51) Int. Cl.
*F21V 1/14* (2006.01)
*F21V 33/00* (2006.01)

(52) U.S. Cl. ..... 362/85; 362/191; 362/253; 362/287; 362/296.05; 362/427

(58) Field of Classification Search ..... 362/85, 362/191, 253, 287, 296.05, 427
See application file for complete search history.

(56) References Cited

U.S. PATENT DOCUMENTS 4,617,612 A * 10/1986 Pritchett ..... 362/33
4,683,526 A * 7/1987 Krogsrud et al. ..... 362/346
6,089,724 A * 7/2000 Shore et al. ..... 362/85
2008/0186699 A1 * 8/2008 Saez et al. ..... 362/191

OTHER PUBLICATIONS

SOTO LED Task Lights, www.details-worktools.com, Steelcase Company, pp. 1-2, Sep. 2009.
Lim Haworth, Y Under Worksurface Mount in Black, pp. 1-2, Jan. 1, 2009.

* cited by examiner

*Primary Examiner* — Stephen F Husar
*Assistant Examiner* — James Cranson, Jr.
(74) *Attorney, Agent, or Firm* — McGarry Bair PC

(57) ABSTRACT

A task light assembly comprises a light head comprising a shade with an illuminator mounted therein, a support configured to suspend the light head above a work area and an adaptor mounted to the support and adjustably receiving at least a portion of the light head for lateral movement of the light head lateral position with respect to the support. The light head can be configured to project an asymmetrical light pattern onto a desired location on a work area and the asymmetrical light pattern can have a maximum intensity located laterally beyond the light head lateral position.

30 Claims, 14 Drawing Sheets

TASK LIGHT

CROSS-REFERENCE TO RELATED APPLICATION(S)

This application claims the benefit of U.S. Provisional Patent Application No. 61/145,559, filed Jan. 18, 2009, which is incorporated herein by reference in its entirety.

BACKGROUND OF THE INVENTION

Appropriate illumination of work surfaces can be an important element of providing a productive and healthy work environment. When working on a personal computer (PC), a user may need to refer to a variety of different types of materials that are typically located on a work surface adjacent the PC. For example, a user may be referring to a written document or other item while performing a work task on the PC.

Currently, there are two primary types of PCs that are typically used in a workplace, a desktop PC and a portable or laptop PC. Desktop PCs generally have a physically separate central processing unit (CPU), monitor, mouse and keyboard, which are typically not designed to be portable. Laptop PCs generally have a CPU, monitor, keyboard and touchpad integrated into a single assembly that is designed to be at least somewhat portable. Appropriate illumination of work surfaces, such as a desk surface, adjacent these different types of PCs, is often not adequately addressed.

For example, excessively bright overhead lighting can cause glare on PC monitors and can waste energy. Conversely, inadequately lighted work areas can cause eye strain and fatigue, especially in older workers. In addition, many users can have both a desktop PC and a laptop PC, which can further complicate the issue of appropriately illuminating work surfaces.

BRIEF DESCRIPTION OF THE INVENTION

According to an embodiment of the invention, a task light assembly comprises a light head comprising a shade with an illuminator mounted therein, a support configured to suspend the light head above a work area and an adaptor mounted to the support and adjustably receiving at least a portion of the light head for lateral movement of the light head lateral position with respect to the support. The light head can be configured to project an asymmetrical light pattern onto a desired location on a work area and the asymmetrical light pattern can have a maximum intensity located laterally beyond the light head lateral position.

According to another embodiment of the invention, the light head can further comprise a reflector mounted within the shade. The directional reflector can be mounted to the shade at an angle approximating 45 degrees with respect to horizontal. The directional reflector can also comprise a truncated cylindrical body. The truncation of the cylindrical body of the directional reflector is generally aligned with a horizontal plane.

According to another embodiment of the invention, the light head can further comprise a heat sink associated with the illuminator. The light head can also comprise at least one vent for releasing heat from within the light head shade.

According to another embodiment of the invention, the support comprises a computer monitor. The adaptor can be mounted along an upper portion of the monitor and can be mounted in a generally horizontal configuration. The adaptor can also be integrally formed into a body of the computer monitor.

According to another embodiment, the support can comprise a generally horizontal surface suspended above the work surface, a generally vertical surface suspended above the work surface, a laptop computer, a generally vertically-extending arm supported on the work surface by a base and a clamp for mounting the support and attached adapter to a workplace item. The base can be weighted for maintaining support of the light head during extended lateral movement of the light head relative to the base.

According to another embodiment of the invention, the adaptor can comprise an elongated sleeve having an external portion mounted to the support. The light head can also comprise a mounting arm that is received within the sleeve for slidable movement with respect to the sleeve.

According to another embodiment of the invention, a power cord can be operably interconnected with the illuminator within the light head, and the mounting arm can comprise an elongated recess for receiving the power cord so that the power cord does not impede movement of the mounting arm of the light head with respect to the adapter. The adapter and/or the support can also have an elongated recess in register with the elongated recess on the mounting arm of the light head so that the power cord can be routed from the light head to the support.

According to another embodiment of the invention, the adapter sleeve is open at each axial end thereof and the mounting arm on the light head can be inserted into either axial end for slidable movement with respect to the sleeve. The adapter sleeve can also have an elongated slot extending at least partially along the longitudinal length thereof. The mounting arm can be laterally inserted into the elongated slot for mounting the mounting arm of the light head for slidable movement with respect to the adapter sleeve. The adapter sleeve can be formed from a generally resilient material, and a lateral width of the elongated slot of the adapter sleeve can be less than the width of the mounting arm of the light head, such that the light head can be snap-fit into the adapter sleeve by laterally forcing the mounting arm of the light head into the longitudinal slot of the adapter sleeve. The mounting arm of the lighting head can rotate within the adaptor sleeve.

According to another embodiment of the invention, the light head can comprise a pivot mount, such that the light head can pivot about an axis not parallel to the adapter. The pivot mount can comprise a mounting flange extending from the lamp head body and a mounting arm can be pivotally coupled to the mounting flange such that the lamp head can pivot with respect to the mounting arm.

According to another embodiment of the invention, the illuminator is an incandescent light bulb or an LED-based light source.

According to another embodiment of the invention, the task light assembly comprises a power switch for selectively controlling power to the illuminator. The power switch can comprise a touch-sensitive portion on the light head shade, such that user contact with the light head shade actuates the power switch. Alternatively, the power switch can be mounted on the power cord.

DESCRIPTION OF AN EMBODIMENT OF THE INVENTION

Figure 1:
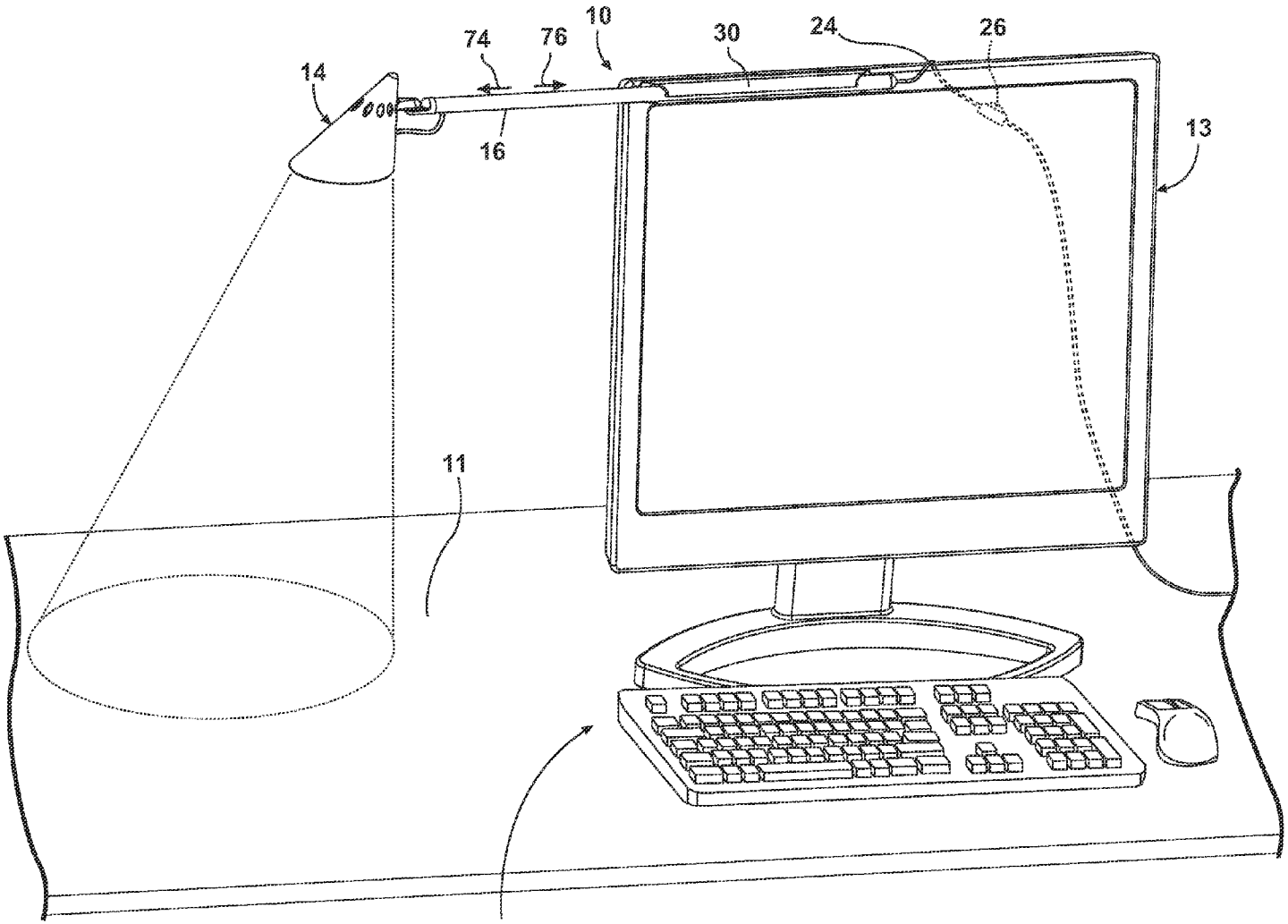
FIG. 1 is a perspective view of a task light assembly mounted to a personal computer according to an embodiment of the invention.
Figure 2:
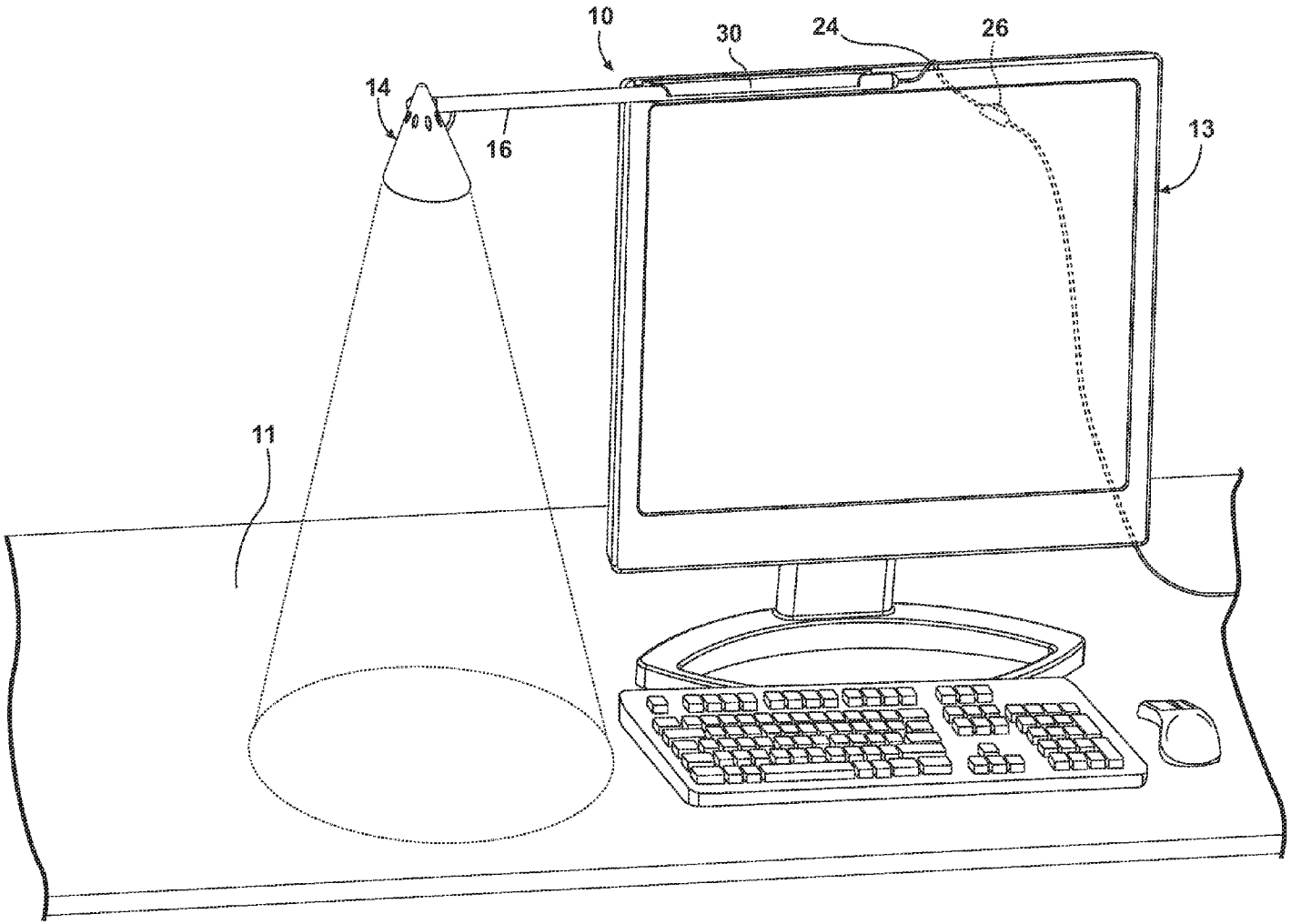
FIG. 2 is a perspective view of the task light assembly of FIG. 1 illustrating a rotation of a light head relative to the personal computer according to an embodiment of the invention.

FIGS. 1 and 2 illustrate a task light assembly 10 that can be used to illuminate a work surface 11. Non-limiting examples of a work surface 11 include, a desk, table, work bench, shelf, and countertop. The task light assembly 10 can be used to illuminate a work surface 11 adjacent a personal computer PC 12 having a monitor 13. While the embodiments of the invention are described in the context of illuminating a work surface 11 adjacent a PC 12, the embodiments of the invention are not limited to use adjacent a PC 12 and it will be understood that the embodiments of the invention can also be used to illuminate a work surface adjacent other objects, such as a TV monitor, a wall and a telephone, for example.

Figure 3:
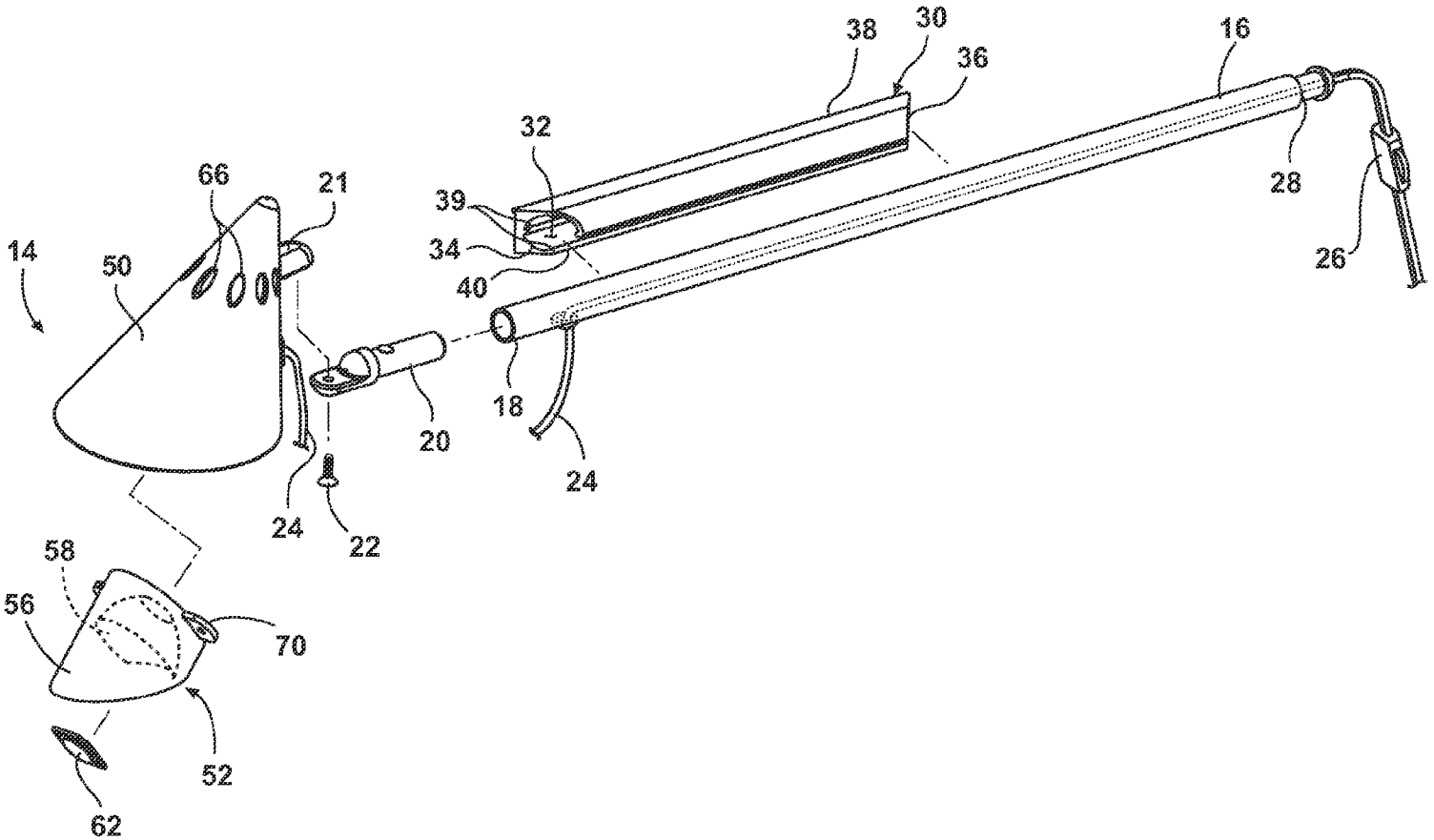
FIG. 3 is an exploded view of the task light assembly of FIG. 1 according to an embodiment of the invention.

Referring now to FIG. 3, the task light assembly 10 can comprise a light head 14 and a mounting arm 16. The light head 14 can be rotatably coupled with a first end 18 of the mounting arm 16 through a pivot mount 20 such that the light head 14 can pivot about a vertical axis orthogonal to the mounting arm 16. The pivot mount 20 can be in the form of a coupler that is sized at a first end so as to be received within the first end 18 of the mounting arm 16. The pivot mount 20 can be secured to the mounting arm 16 through a friction fit and also optionally by a mechanical fastener such as a screw or set pin. The pivot mount 20 can be rotatably coupled at a second end opposite the first with the light head 14 through a mounting flange 21 projecting from the light head 14 using a screw or pin 22.

Referring again to FIGS. 1 and 2, the light head 14 can be coupled with a conventional power cord 24 that can be plugged into a power socket (not shown) for providing power to the light head 14. Alternatively, the power cord 24 can be provided with a USB, firewire or other suitable interface such that the power cord 24 can be plugged into the PC 12 for providing power to the light head 14. The power cord 24 can also be provided with a cord mounted switch 26 for selectively providing power to the light head 14. Alternatively, the light head 14 can be selectively operated through a touch sensitive pressure switch located on the light head 14, as is known in the art.

The power cord 24 can be mounted to the mounting arm 16 using any suitable mechanical fastener, such as a bracket or tie, or non-mechanical fasteners, such as an adhesive. Alternatively, as illustrated in FIG. 3, the mounting arm 16 can be provided with a cavity extending longitudinally along the length of the mounting arm 16 through which the power cord 24 can extend. The power cord 24 can enter the mounting arm 16 adjacent the first end 18 of the mounting arm 16, extend through the mounting arm 16 and exit at a second end 28 of the mounting arm 16. The mounting arm 16 can be provided with one or more grommets or cord strain relief components at the exit and entry points of the mounting arm 16 for protecting the power cord 24, as is known in the art.

The mounting arm 16 can be made from any suitable plastic or metal material and can have any suitable length. For example, the mounting arm 16 can be made from steel or aluminum, which can be powder coated or polished depending on the desired appearance. One example of a suitable length for use with a standard size monitor 13 is 14".

The task light assembly 10 can also include an adaptor in the form of a sleeve 30 for mounting the light head 14 to the monitor 13. The sleeve 30 can comprise a channel 32 open at first and second ends 34, 36 for receiving the mounting arm 16. The sleeve 30 can also comprise a mounting surface 38 on a rear side of the sleeve 30 opposite an opening 40 to the channel 32. The mounting surface 38 can be flat, angled or rounded. The channel 32 can be sized so that the mounting arm 16 can move telescopically and rotatably within the sleeve 30. An interior surface of the channel 32 and/or the opening 40 can also be provided with one or more projections 39 for frictionally engaging the mounting arm 16, although it is within the scope of the invention for the interior surface of the channel 32 to not contain any projections 39. Alternatively, the mounting arm 16 and/or the interior surface of the channel 32 can be made from or provided with a surface that provides a desired resistance between the mounting arm 16 and the interior surface of the channel 32.

The sleeve 30 can be made from a resilient material such that the mounting arm 16 can be snap-fit into the channel 32 through the opening 40. Alternatively, the mounting arm 16 can be slid into the channel 32 by threading the power cord 24 and second end 28 of the mounting arm 16 through either the open end 34 or the open end 36 depending on the desired direction of the light head 14.

The sleeve 30 can be mounted to the monitor 13 through the mounting surface 38 as illustrated in FIG. 1 using any suitable mechanical fastener, such as screws, pins or clips, or non-mechanical fastener, such as hook and loop tape, Velcro®, or an adhesive. For example, the hook side of a strip of Velcro® can be adhered to an upper portion of the monitor 13 and the corresponding loop side of a strip of Velcro® can be adhered to the mounting surface 38 of the monitor 13. In this manner, the sleeve 30 can be quickly and easily mounted to and removed from the monitor 13. It is also within the scope of the invention for the sleeve 30 to be formed as part of a housing forming the monitor 13.

Figure 4:
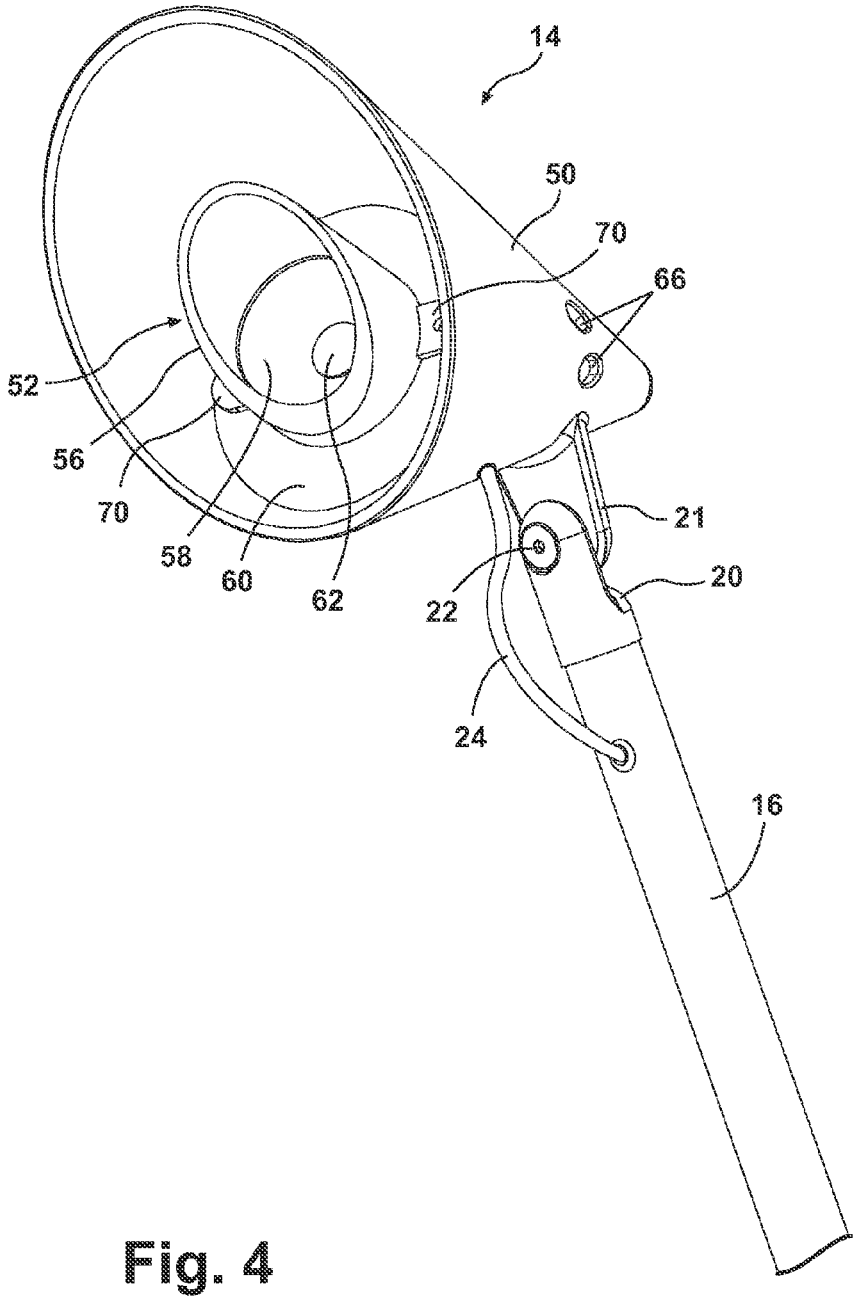
FIG. 4 is a perspective view of a light head according to an embodiment of the invention.
Figure 5:
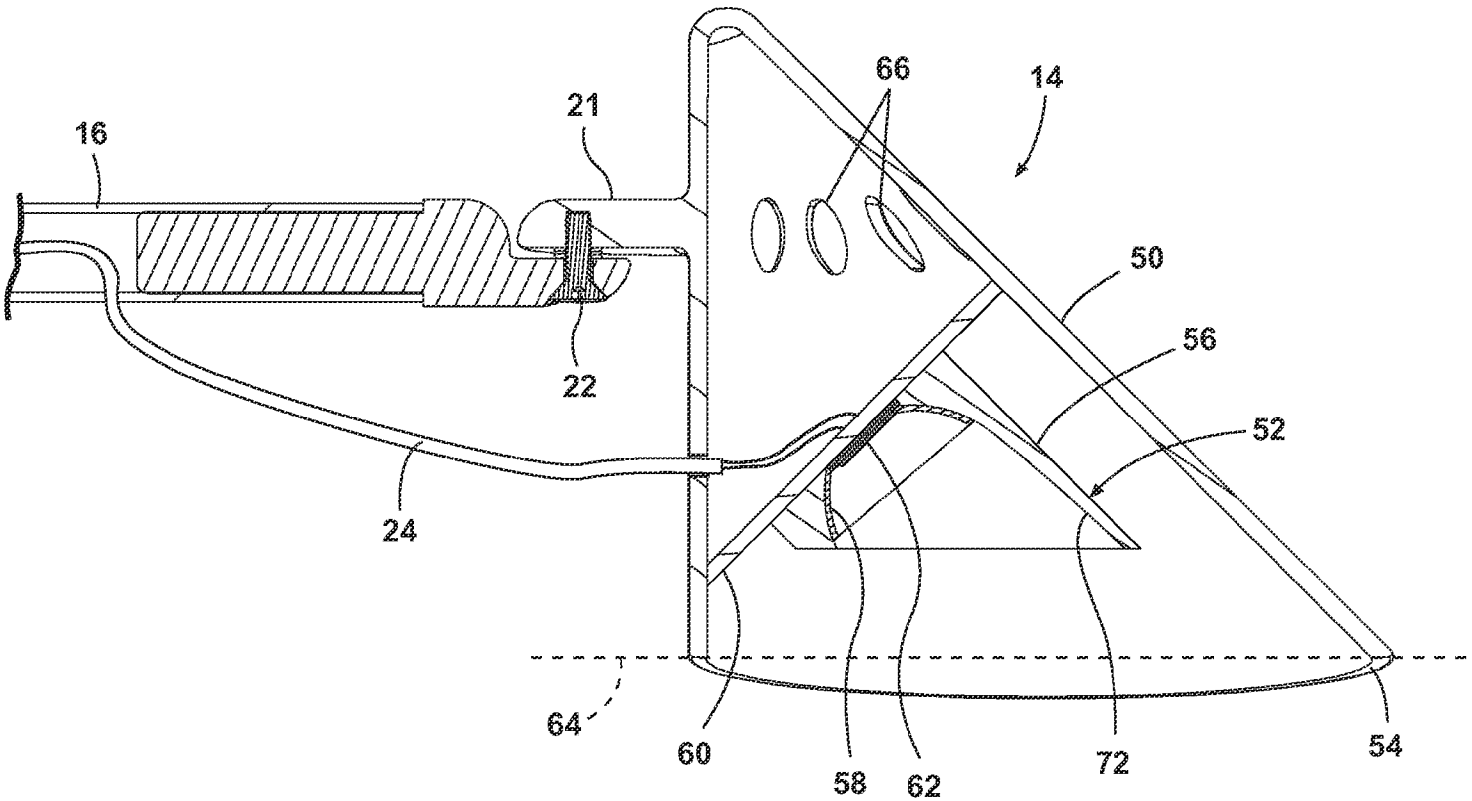
FIG. 5 is a cross-sectional view of the light head of FIG. 4 according to an embodiment of the invention.

Referring now to FIGS. 4 and 5, the light head 14 can comprise a shade 50 and a directional reflector 52 located within an interior of the shade 50. The shade 50 can be in the form of a hollow cone having an open base 54 for emitting light from within the shade 50. The directional reflector 52 can comprise a first reflector 56 and a second reflector 58 mounted within the first reflector 56. The light head 14 can further comprise a mounting plate 60 within the shade 50 for mounting a light source 62, such as an LED and the directional reflector 52.

The mounting plate 60 can extend across the width of the shade 50 and be spaced from the open base 54 at a 45 degree angle from a horizontal plane 64 defined by the open base 54, as illustrated in FIG. 5. The light source 62 and reflector 52 can be mounted to the mounting plate 60 using any suitable mechanical fastener, such as a screw or pin, or a non-mechanical fastener, such as an adhesive or a weld.

For example, as illustrated in FIG. 4, the first reflector 56 can be provided with a pair of mounting flanges 70 for securing the first reflector 56 to the mounting plate 60 by a pair of screws, as is known in the art. The directional reflector 52 and the light source 62 can be secured to the mounting plate 60 such that the directional reflector 52 is centered about the light source 62.

The mounting plate 60 can be made from any suitable plastic or metal material. For example, the mounting plate 60 can be made from die cast aluminum such that it also acts as a heat sink for the light source 62. In another example, the mounting plate 60 can be made from plastic and provided with a suitable heat sink for dissipating the heat generated by the light source 62. The shade 50 can also be provided with one or more apertures 66 to provide ventilation to the interior of the shade 50 to further promote heat dissipation. The apertures 66 can be of any suitable size, shape and number.

The second reflector 58 can be in the shape of a truncated cone cut through at an apex of the cone to provide an opening through which emitted light from the light source 62 can pass. The second reflector 58 can be any suitable type of reflector for focusing the light emitted by the light source 62 onto a surface opposite the light source 62. One example of a suitable reflector is the KCLP series offered by Khatod® Optoelectronic, Italy, having a 40 degree lens angle.

The first reflector 56 can be in the shape of a cylinder cut diagonally at a 45 degree angle relative to a base of the cylinder. An inner surface 72 of the first reflector 56 can be treated or coated so as to provide a reflective surface for focusing the light emitted by the LED 62. For example, the inner surface 72 can be vacuum plated with high reflectance specular aluminum. It is also within the scope of the invention for the first and second reflectors 56 and 58 to be integrally formed such that the reflector 52 comprises a single piece. The first and second reflector 56 and 58 work together to focus the light emitted by the light source 62 such that the light head 14 projects an asymmetrical light distribution pattern.

The light source 62 can be any suitable type of light source such as an incandescent light bulb, a fluorescent light bulb and an LED. The LED light source can be a single LED, an array of LEDs or a cluster of LEDs. One example of a suitable LED is a CL-L251 4 Watt, 480 mA, 4000K LED from Citizen Electronics Co.

Referring again to FIGS. 1 and 2, in use, the sleeve 30 can be mounted horizontally to an upper portion of the monitor 13, such as an upper portion of a frame of the monitor 13, as illustrated. The mounting arm 16 can be slid into the sleeve 30 through the first open end 34 or snapped into the channel 32 through the channel opening 40 such that the light head 14 extends away from the monitor 13. The power cord 24 can be pulled through the open second end 36 and draped over an upper edge of the monitor 13 such that the power cord 24 is not blocking the monitor screen. The distance between the cord mounted switch 22 and an end of the mounting arm 16 can be selected such that the cord mounted switch 22 can be easily reached by the user when it is draped over the upper edge of the monitor 13.

Referring again to FIGS. 1 and 2, the mounting arm 16 can be telescopically received within the sleeve 30 such that the mounting arm 16 can be moved in the direction of arrows 74 and 76 to adjust the distance between the light head 14 and the monitor 13 according to a user's need to illuminate the work surface 11 at varying distances away from the monitor 13. The mounting arm 16 can also be rotatably received within the sleeve 30 such that the mounting arm 16 can rotate about a horizontal axis parallel to the sleeve 30. In one example, the mounting arm 16 can automatically rotate within the sleeve 30 due to gravity when the angle of the monitor 13 is adjusted, such that the open base 54 remains parallel to the work surface 11, regardless of the angle of the monitor 13. Alternatively, the mounting arm 16 can be selectively rotatable within the sleeve 30 such that a user can selectively adjust the angle of the open base 54, and thus the projection of light from the light head 14, to illuminate a desired surface. For example, the user can rotate the mounting arm 16 within the sleeve 30 to illuminate an office wall or a picture frame standing on the work surface 11.

As illustrated in FIGS. 1 and 2, the light head 14 can also be pivoted about a vertical axis orthogonal to the sleeve 30 to selectively illuminate a desired area of the work surface 11, providing the user with additional flexibility and control in illuminating a desired work surface.

The directional reflector 52 projects light from the light head 14 in an asymmetrical pattern such that the maximum intensity of the projected light is located at some distance spaced laterally away from the light head 14. The asymmetrical pattern projected by the light head 14 is illustrated schematically in FIG. 6A for the purposes of discussion.

Figure 6B:
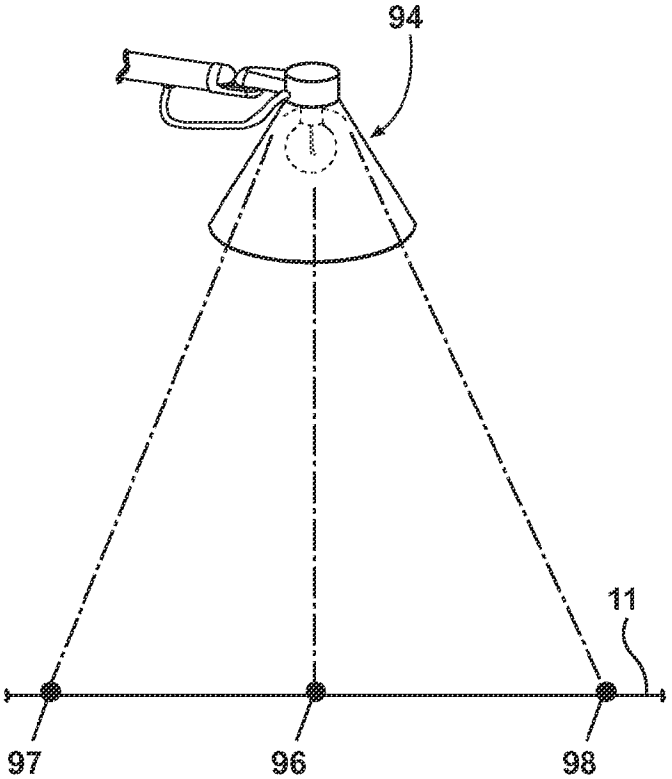
FIG. 6B (PRIOR ART)
FIG. 6B is a schematic illustrating a symmetrical projected light pattern projected onto a worksurface by a traditional lighting device.
Figure 6A:
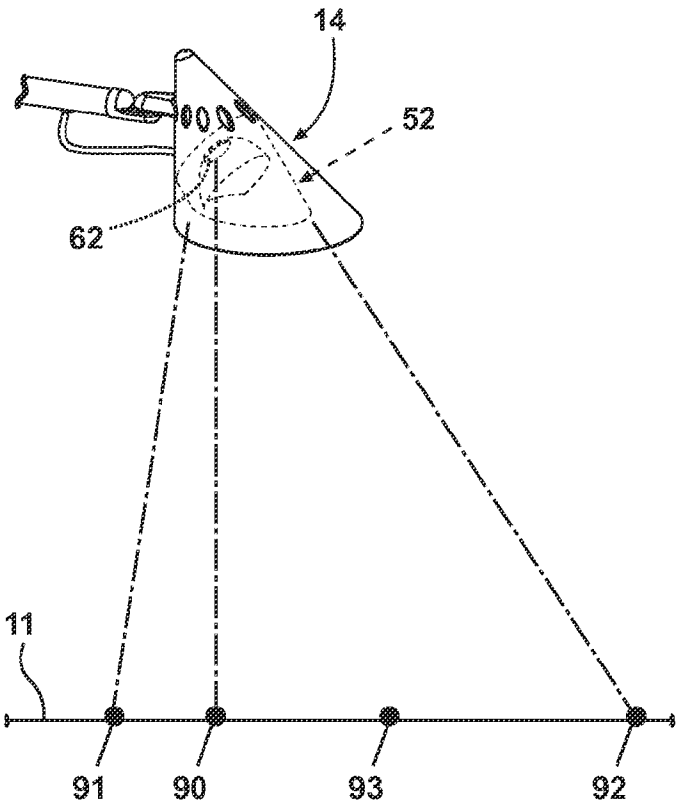
FIG. 6A is a schematic illustrating an asymmetrical projected light pattern according to an embodiment of the invention.

Referring now to FIG. 6A, when the light head 14 is positioned above a work surface 11, a zero point 90 can be defined as the position on the work surface 11 directly below the light source 62. The asymmetrical light pattern projected by the light head 14 can extend from a point 91 rearward of the zero point 90 to a point 92 laterally spaced forward from the zero point 90. As illustrated in FIG. 6A, the majority of the light projected by the light head 14 is projected onto the work surface 11, in the direction of extension of the light head 14 and forward of the zero point 90. The asymmetrical distribution of light provides in an area of maximum intensity 93 located on the work surface 11 at a forward position relative to the zero point 90.

FIG. 6B illustrates a schematic of a symmetrical light pattern projected onto a work surface 11 by a traditional lighting device 94. The traditional lighting device 94 projects a light pattern that is symmetrical with respect to a zero point 96 defined as the position on the work surface 11 directly below the light source. The projected light pattern extends equally in all directions relative to the zero point 90, as illustrated by rearward and forward points 97 and 98, respectively. The symmetrical distribution of light also results in an area of maximum intensity that corresponds to the zero point 90.

The asymmetrical light pattern projected by the light head 14 provides several advantages compared to the symmetrical light pattern projected by the traditional lighting device 94. With the traditional lighting device 94, the light is projected symmetrically onto the work surface 11 in all directions relative to the zero point 96 and the area of maximum intensity corresponds to the zero point 96, which is directly underneath the lighting device 94. Because the area of maximum intensity is directly underneath the lighting device 94, it is difficult for the user to take advantage of the area of maximum intensity unless the lighting device 94 is spaced significantly far above the work surface 11. If the lighting device 94 is not spaced significantly far above the work surface 11, the user may hit his or her head on the lighting device 94 when trying to view an object in the area of maximum light intensity directly beneath the lighting device 94. The lighting device 94 can be designed so as to space the lighting device 94 significantly far above the work surface so that a user can avoid hitting his or head when viewing an object in the area of maximum intensity, however, this can result in a lighting device 94 that is not very compact. In addition, when the user leans over the area of maximum intensity to view an object, the user's head can partially block the projected light, since the light source is located directly above the area of maximum intensity.

These issues can be avoided by using the light head 14, which projects an asymmetrical light pattern on the work surface 11. The asymmetrical light pattern of the light head 14 focuses the projected light such that the majority of the light projected onto the work surface 11 is spaced forward of the zero point 90 of the light head 14. In addition, the area of maximum intensity 93 is located at a forward position relative to the zero point 90 of the light head 14. Because the majority of the light projected by the light head 14 and the area of maximum intensity 93 are projected forward of the zero point 90, it is easier for the user to utilize the area of maximum intensity. The light head 14 does not have to be spaced as far above the work surface as the traditional lighting device 94 and therefore can require less room and be more compact than the traditional lighting device 94. Furthermore, because the area of maximum intensity is not located directly below the light head 14, the user can view an object in the area of maximum intensity without blocking the projected light.

In addition, with the traditional lighting device 94, because the area of maximum intensity 96 is located directly below the light source and is therefore not easily accessible, as described above, the traditional lighting device 94 can waste energy in producing light that is not necessary and/or is generally not useful. For example, the traditional lighting device 94 may use a higher wattage light source so that the around the edge of the projected light pattern, illustrated by points 97 and 98, have a desired intensity for illuminating objects, since this is the area that is generally accessible to the user. As the intensity at the edges of the projected light pattern increase, the intensity of light at the area of maximum intensity 96 also increases and can end up being higher than is necessary or desired, wasting energy. Because the area of maximum intensity 93 of the light head 14 is easily accessible by the user, the light head 14 need only be designed to use the energy required to generate the desired intensity at the area of maximum intensity 93.

Another disadvantage of the symmetrical light pattern projected by the traditional lighting device 94 is that because the light is being projected equally in every direction relative to the zero point 96, some of the light may be projected in undesirable directions. For example, light projected rearward of the zero point 96 towards a PC monitor located rearward of the lighting device 94, is not desirable, as it can increase glare on the monitor. In addition, because the light is being projected in all directions, some of the projected light may be reflected back towards the user, producing glare that can cause eye strain and fatigue. The directionality of the asymmetrical light pattern projected by the light head 14 projects the light on the work surface 11 at an angle such that the light reflected by the work surface 11 is reflected away from the user and away from the PC monitor 13. This minimizes glare experienced by the user and can reduce eye strain and fatigue.

While the task light assembly 10 has been described in the context of illuminating a work surface 11 on a left side of a monitor 13, it is understood that the task light assembly 10 can also be used in a similar manner to illuminate a work surface 11 on the right side of the monitor 13.

The task light assembly 10 can be modular in that it can be easily supported relative to a variety of different types of work surfaces using a variety of different types of supports and/or adaptors. Several embodiments for supporting the light head 14 relative to a work surface will now be described. It will be understood that any of the features described in the context of one embodiment can also be used in any of the other embodiments described herein.

Figure 7:
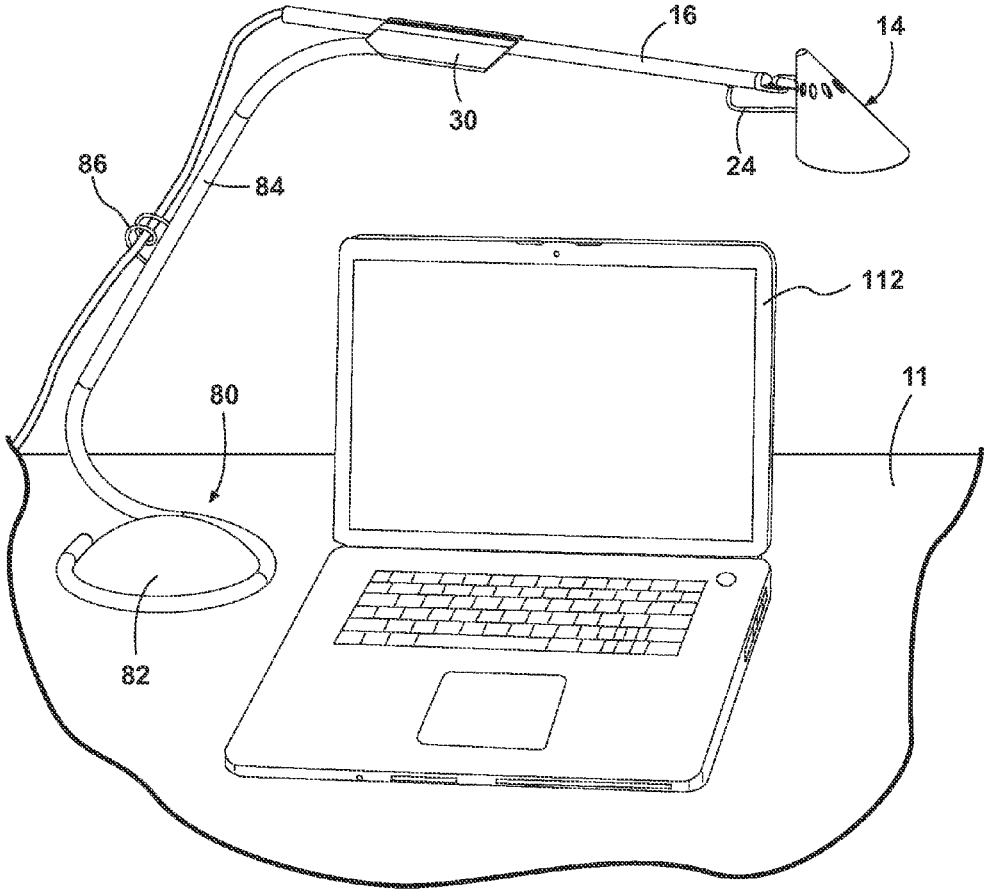
FIG. 7 is a perspective view of a task light assembly supported above a work surface according to an embodiment of the invention.

Referring now to FIG. 7, the light head 14 can also be mounted to a free standing base 80 in a manner similar to that described above for mounting to a PC monitor 13. The free standing base 80 can comprise a foot pedestal 82 and a generally vertical support arm 84. The foot pedestal 82 can be of any suitable size or shape, such as a circle, oval or square, for example, and can be weighted so as to support the light head during lateral movement of the light head relative to the foot pedestal 82. The support arm 84 can have any suitable length and can be vertically oriented or angled, as illustrated in FIG. 7. The support arm 84 can also comprise one or more cord management elements 86 such as one or more hooks, clips, clamps or grooves, for example, for managing the power cord 24 and keeping it away from the illuminated work space.

The support arm 84 can be coupled with the foot pedestal 82 at a first end and coupled with the sleeve 30 at a second end. The sleeve 30 can be fixedly mounted to the support arm 84 or removably mounted to the support arm 84 in a manner similar to that described above with respect to the monitor 13. For example, the sleeve 30 can be removably mountable to both the support arm 84 and the monitor 13 such that the task light assembly 10 can be selectively moved between the free standing base 80 and the monitor 13. Alternatively, the free standing base 80 can be provided with a permanently mounted sleeve 30 for use with the light head 14 and mounting arm 16 as described above. In this manner, the task light assembly 10 can be used with either or both the monitor 13 and the free stand base 80 as a support stand for the task light assembly 10.

As illustrated in FIG. 7, support arm 84 is angled slightly from vertical such that it is leaning in one direction. The angled support arm 84 is intended to be used to support the light head 14 to illuminate a work surface 11 in the direction the support arm 84 is angled. When the free standing base 80 is positioned on the work surface 11 such that the support arm 84 is extending to the right of the foot pedestal 82 in the direction of a laptop computer 112, the mounting arm 16 can be received within the sleeve 30 such that the light head 14 is extending to the right of the free standing base 80 in the direction of the angled support arm 84. To illuminate a work surface 11 to the left of the free standing base 80, the user can simply rotate the free standing base 80 such that the support arm 84 is leaning to the left.

Figure 8B:
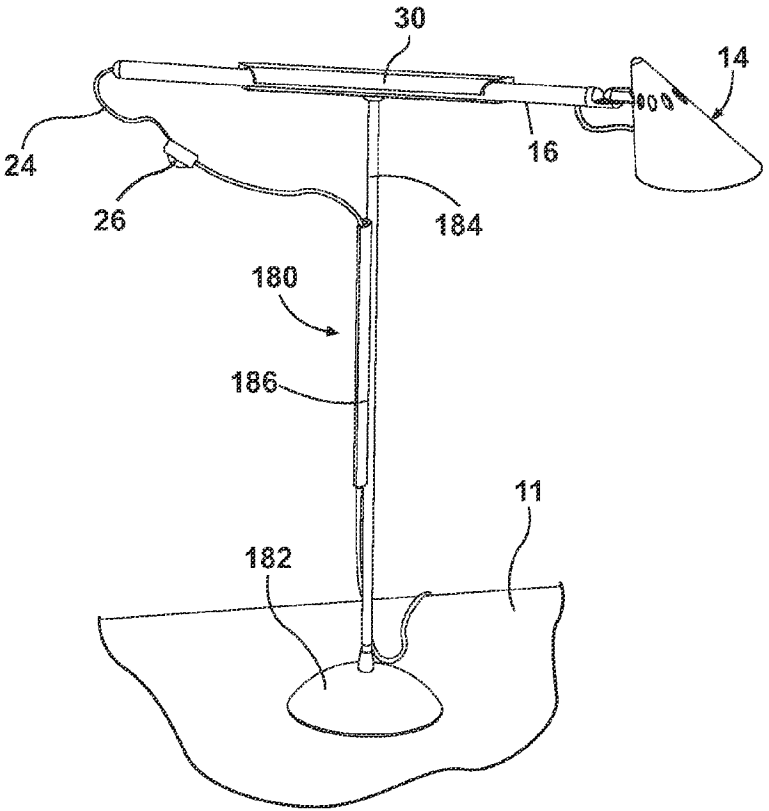
FIG. 8B is a perspective view of a task light assembly supported above a work surface according to an embodiment of the invention.
Figure 8A:
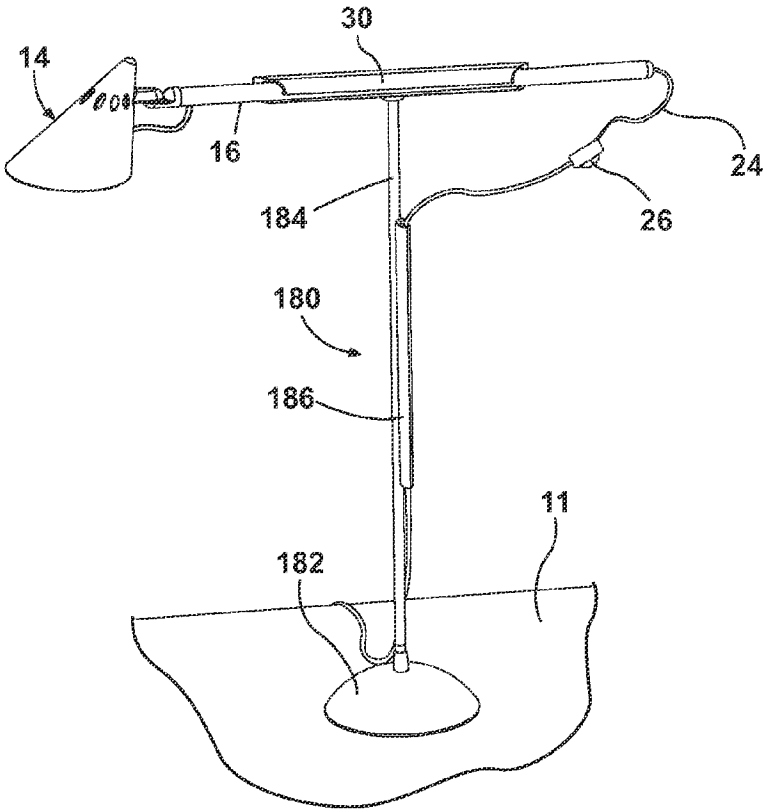
FIG. 8A is a perspective view of a task light assembly supported above a work surface according to an embodiment of the invention.

Referring now to FIGS. 8A and 8B, a free standing base 180, similar to the free standing base 80 is illustrated. Therefore, elements of the free standing base 80 similar to those of free standing base 180 are numbered with the prefix 100.

The free standing base 180 can comprise a foot pedestal 182 and a vertical support arm 184. The support arm 184 can be fixedly or removably mounted to the sleeve 30 as described above in the context of the support arm 84. The sleeve 30 can be mounted to the support arm 184 forming a "T" shape. Depending on the direction in which the mounting arm 16 is inserted into the sleeve 30, the light head 14 can illuminate a workspace to the left, as illustrated in FIG. 8A, or to the right, as illustrated in FIG. 8B, of the free standing base 180 without moving the base 180.

Figure 9:
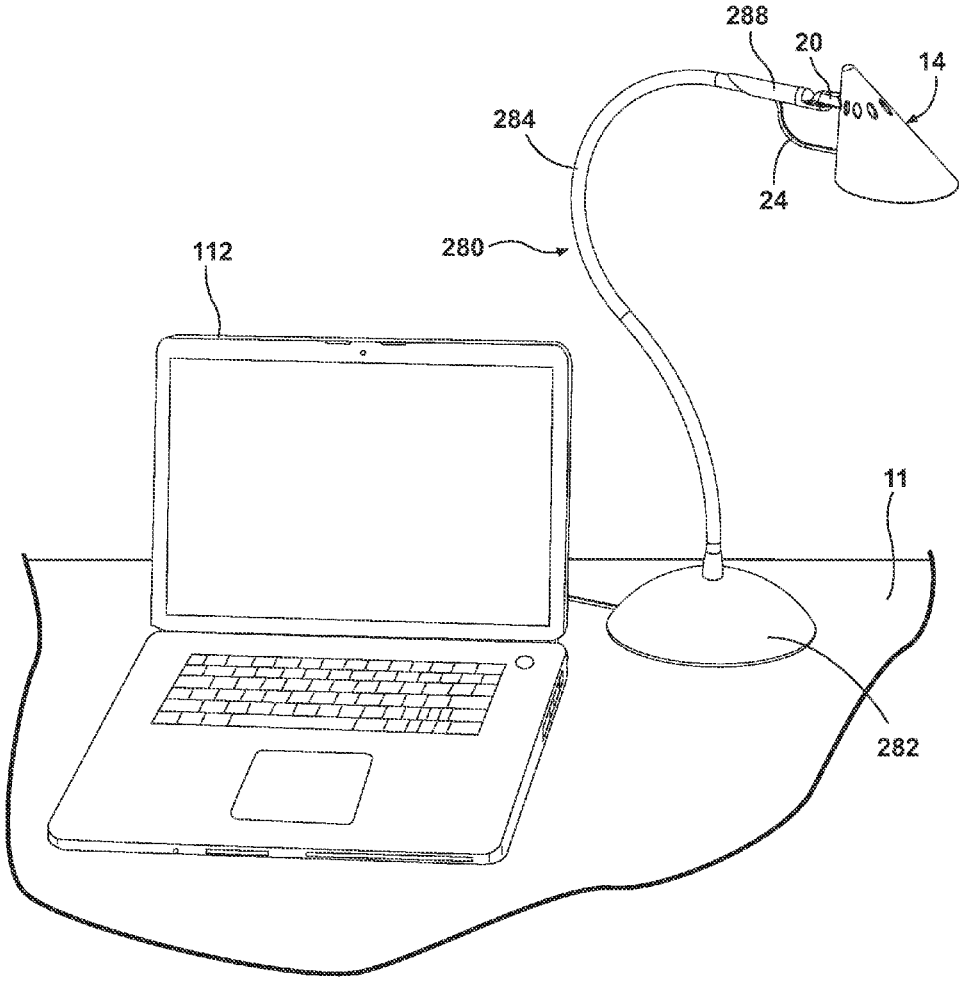
FIG. 9 is a perspective view of a task light assembly supported above a work surface according to an embodiment of the invention.

Referring now to FIG. 9, a free standing base 280 similar to the free standing base 80 is illustrated for mounting the light head 14 above a work surface 11. The free standing base 280 is similar to the free standing base 80 except for the manner in which the light head 14 is mounted to the free standing base 280. Therefore, elements of the free standing base 280 similar to the free standing base 80 will be numbered with the prefix 200.

As illustrated in FIG. 9, the free standing base 280 can comprise a foot pedestal 282 and a support arm 284. In this embodiment, the support arm 284 can be in the form of an adjustable "gooseneck" or flexible member such that the user can bend the support arm 284 to a desired angle and in a desired direction. The light head 14 can be directly mounted to a first end 288 of the support arm 284 through the pivot mount 20 in a manner similar to that described above with reference to the embodiment illustrated in FIG. 3. The support arm 284 can comprise a hollow cavity for receiving the power cord 24 such that the power cord 24 can enter the support arm 284 at an opening adjacent the first end 288 and exit at the base 282.

Figure 10:
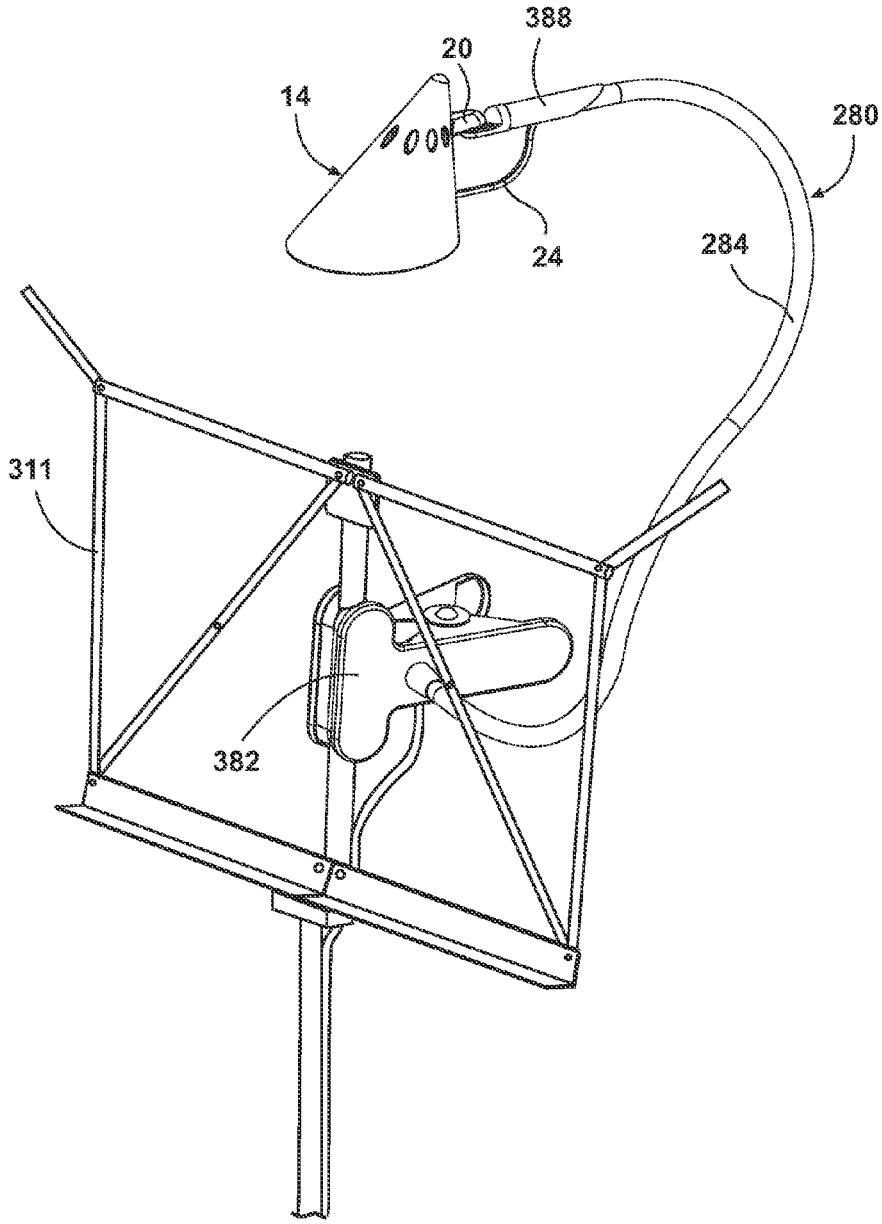
FIG. 10 is a perspective view of a task light assembly supported above a work surface according to an embodiment of the invention.

Referring now to FIG. 10, a clamp mount 380 similar to the free standing base 280 is illustrated for mounting the light head 14 above a work surface. The clamp mount 380 is similar to the free standing base 280 except for the manner in which the light head 14 is secured above the work surface. Therefore, elements of the clamp mount 380 similar to the free standing base 280 will be numbered with the prefix 300.

As illustrated in FIG. 10, the clamp mount 380 can comprise a clamp 382 and a support arm 384 in the form of an adjustable gooseneck. The light head 14 can be directly mounted to a first end 388 of the support arm 384 through the pivot mount 20 as described above with reference to the embodiment illustrated in FIG. 8. The power cord 24 can extend through a hollow cavity within the support arm 384 and exit near the clamp 382. The clamp 382 allows a user to mount the light head 14 to a variety of different horizontal or vertical surfaces. For example, as illustrated in FIG. 9, the light head 14 can be mounted to a music stand 311 to illuminate material supported on the music stand 311. The adjustable gooseneck support arm 384 provides added flexibility to the user to be able to adjust the height and angle of the light head 14 relative to the music stand 311. The clamp 382 can also be used to mount the light head 14 to the edge of a table or desk for illuminating a work surface.

Figure 11:
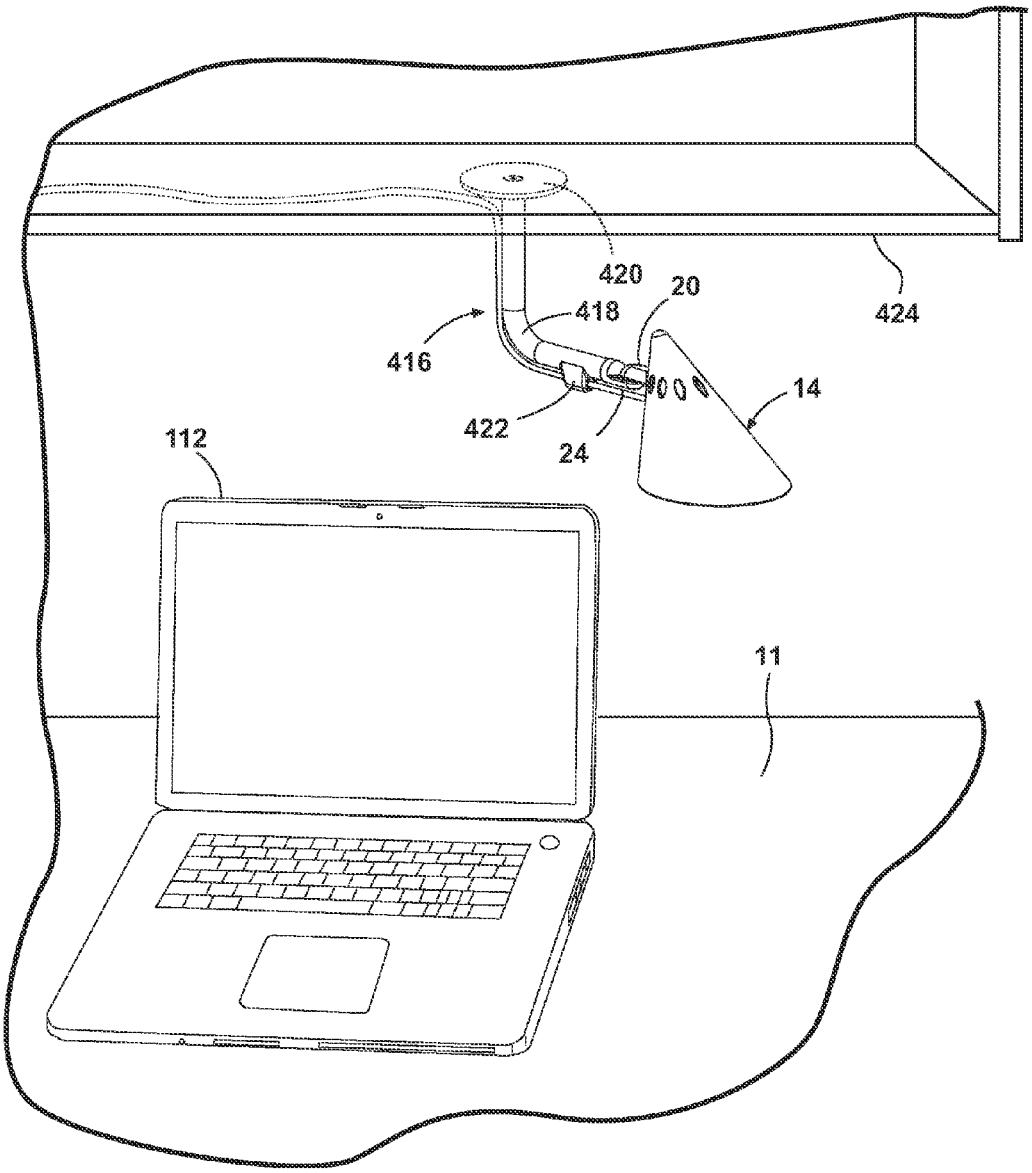
FIG. 11 is a perspective view of a task light assembly supported by a generally horizontal surface above a work surface according to an embodiment of the invention.

FIG. 11 illustrates another embodiment of the invention in which the light head 14 is supported above a work surface 11 by a bracket 416 mounted to a surface adjacent to the work surface 11. The bracket 416 can comprise a generally L-shaped mounting arm 418 having a mounting surface 420 at a first end. The light head 14 can be coupled with the mounting arm 418 at a second arm opposite the first arm through the pivot mount 20. The pivot mount 20 can be secured to the second end of the mounting arm 418 in a manner similar to that described above with reference to the embodiment illustrated in FIG. 3. The mounting arm 418 can also be provided with a cord management element 422 for directing the power cord 24 away from the work surface 11.

The bracket 416 can be mounted to a horizontal surface 424 adjacent, but space above, the work surface 11, such as an underside of a shelf or cabinet, as illustrated in FIG. 11. The mounting surface 420 of the bracket 416 can be fixedly or removably secured to the horizontal surface 424 of the shelf using a mechanical fastener, such as a screw or pin, or a non-mechanical fastener, such as Velcro®, an adhesive, a magnet and hook and loop tape, for example.

Figure 12:
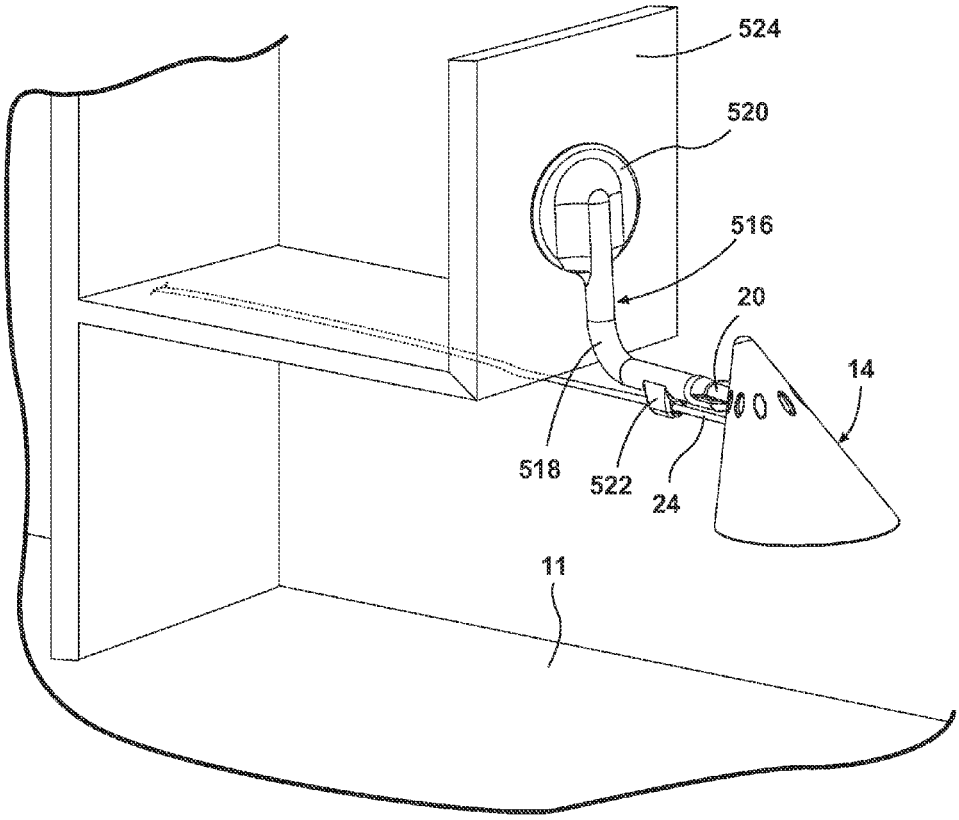
FIG. 12 is a perspective view of a task light assembly supported by a generally vertical surface above a work surface according to an embodiment of the invention.

FIG. 12, illustrates a bracket 516 similar to the bracket 420 except for the manner in which the bracket 516 is mounted to a surface. Therefore, elements of the bracket 420 similar to the bracket 520 will be numbered with the prefix 500.

The bracket 516 can comprise a generally L-shaped mounting arm 518 having a mounting surface 520 at a first end. The light head 14 can be coupled with the mounting arm 518 at a second arm opposite the first arm through the pivot mount 20. The pivot mount 20 can be secured to the second end of the mounting arm 518 in a manner similar to that described above with reference to the embodiment illustrated in FIG. 3. The mounting arm 518 can also be provided with a cord management element 522 for directing the power cord 24 away from the work surface 11.

The bracket 516 can be mounted to a vertical surface adjacent 524, but space above, the work surface 11, such as a wall or the side of a shelf or cabinet, as illustrated in FIG. 12. The mounting surface 520 of the bracket 516 can be fixedly or removably secured to the vertical surface 524 of the shelf using a mechanical fastener, such as a screw or pin, or a non-mechanical fastener, such as Velcro®, an adhesive, a magnet and hook and loop tape, for example. Alternatively, the mounting surface 520 can be designed so as to be capable of being mounted to a slot wall, such as is often found in office cubicles, for example.

Figure 13A:
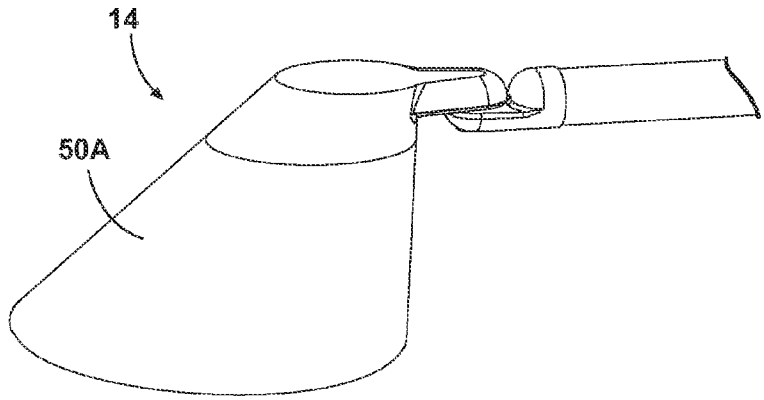
FIGS. 13A through 13F are perspective views of a shade for the light head of FIG. 4 according to an embodiment of the invention.

While the shade 50 of the light head 14 is illustrated as being in the shape of an asymmetrical cone, the shade 50 can have any desired shape. FIGS. 13A through 13F illustrate a variety of non-limiting examples of shapes that can be used for the shade 50 of the light head 14. For example, FIG. 13A illustrates a shade 50A similar to shade 50 except that the apex of the cone has been truncated.

Figure 13B:
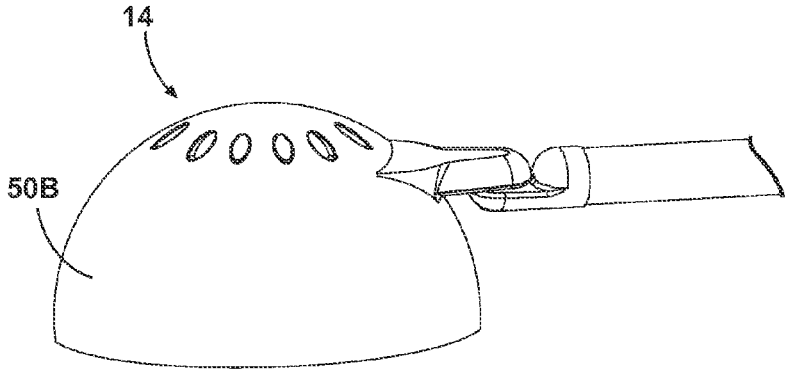
Figure 13C:
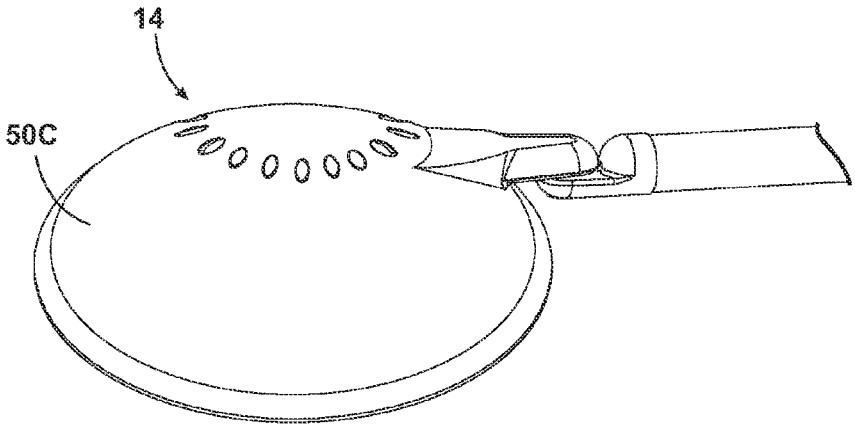
Figure 13D:
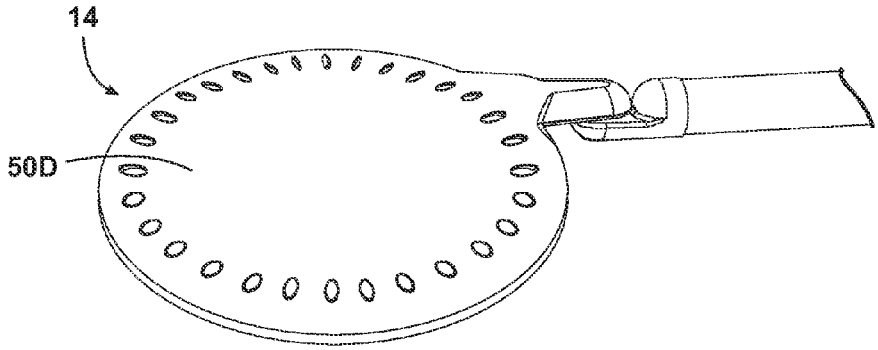
Figure 13E:
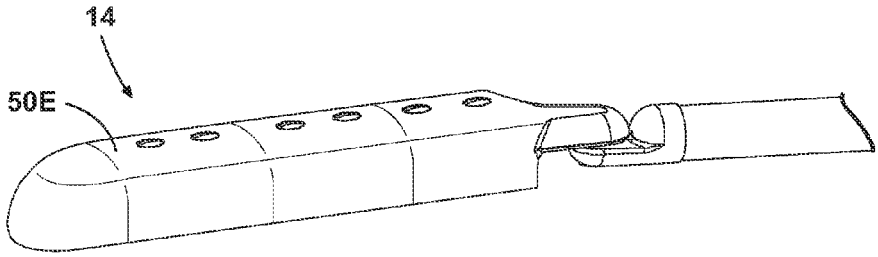
Figure 13F:
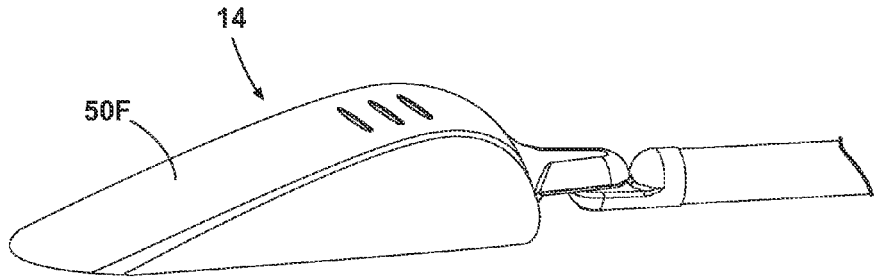

FIGS. 13B, 13C and 13D illustrate examples of spherical shades 50B, 50C and 50D, respectively, that can be used with the light head 14. FIGS. 13E and 13F illustrate examples of rectangular shades 50E and 50F, respectively that can be used with the light head 14. The spherical shades 50B, 50C, 50D, 50E and 50F can be symmetrical or asymmetrical and can have a variety of different depths.

It is also within the scope of the invention for the light head 14 to comprise multiple light sources 62 and reflectors 52. For example, the light head 14 illustrated in FIG. 12E having the shade 50E can be used with an array of LED lights and corresponding reflectors 52 extending transversely down the length of the shade 50E. In another example, a cluster of LEDs can be used with one or more reflectors 52.

The invention described herein provides an energy efficient, economical and compact task light assembly that can be used to appropriately illuminate a work surface adjacent both a desktop PC and a laptop PC. The light head 14 can be telescopically and rotationally mounted to any PC monitor, to supply high quality, amiable, ergonomic illumination to the work surface adjacent to the PC monitor, either to the left or right.

Securing the task light assembly directly to the PC monitor saves space by not taking up any valuable work space adjacent the PC. In other embodiments, the task light assembly can be mounted to a surface adjacent the work surface, such as a wall or shelf, providing the desired illumination, while not taking up work space adjacent to the PC. The tasklight system can also be used to appropriately illuminate a work surface adjacent a PC using a free standing base or clamp according to any one of several embodiments of the invention described herein.

The sleeve 30 and mounting arm 16 can be used to mount the light head 14 to both a monitor and a free standing base, to appropriately illuminate a work surface adjacent both a desktop PC and a laptop PC. The user can easily move the light head 14 from one type of support to another to illuminate a work surface according to the user's needs by simply moving the light head 14 between support types. In this manner, when the user moves from working on a desktop PC to a laptop PC, for example, or some other work space not adjacent the desktop PC, the user can easily move the light head 14 to illuminate the work surface as desired.

The directional reflector described herein and the resulting asymmetrical light pattern that is projected onto the surface has several advantages over a traditional lighting device which projects a symmetrical light pattern, as discussed above. The asymmetrical light pattern provides light focused to a desired area and wastes little energy in projecting light in undesirable and/or unnecessary directions. The asymmetrical light pattern also reduces glare that can cause eye strain and user fatigue. The projected asymmetrical light pattern also provides an area of illumination which presents easier access to the area of maximum intensity.

When the light source is an LED-based light source, the task lighting assembly can provide several advantages over traditional lighting assemblies which use incandescent or compact fluorescent light bulbs. LEDs typically have a lower energy consumption, longer lifetime, fast cycling times, smaller size and do no not contain mercury, like fluorescent light bulbs. In addition, LEDs do not die as quickly as fluorescent lights when frequently turned on and off.

In addition, because the light emitted by light source is focused by the reflector 52 and not the shade 50, the light head 14 can be provided with any style and/or type of shade, several examples of which are illustrated in FIGS. 13A-13F, without effecting the asymmetrical light pattern projected by the light head 14. In this manner, the task light assembly can be easily designed to fit any desired aesthetic.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A task light assembly comprising:

a light head comprising a shade with an illuminator mounted therein, wherein the light head is configured to project an asymmetrical light pattern;

a support configured to suspend the light head above a work area; and an adapter mounted to the support and adjustably receiving at least a portion of the light head for lateral movement of the light head lateral position with respect to the support;

wherein the light head projects the asymmetrical light pattern onto a desired location on the work area and wherein the asymmetrical light pattern has a maximum intensity located laterally beyond the light head lateral position.

2. The task light assembly according to claim 1 wherein the light head further comprises a directional reflector mounted within the shade.

3. The task light assembly according to claim 2 wherein the directional reflector is mounted to the shade at an angle approximating 45 degrees with respect to horizontal.

4. The task light assembly according to claim 2 wherein the directional reflector comprises a truncated cylindrical body.

5. The task light assembly according to claim 4 wherein the truncation of the cylindrical body of the directional reflector is generally aligned with a horizontal plane.

6. The task light assembly according to claim 1 wherein the light head further comprises a heat sink associated with the illuminator.

7. The task light assembly according to claim 1 wherein the shade further comprises at least one vent for releasing heat from within the shade.

8. The task light assembly according to claim 1 wherein the support comprises a computer monitor.

9. The task light assembly according to claim 8 wherein the adapter is mounted along an upper portion of the monitor.

10. The task light assembly according to claim 8 wherein the adapter is mounted to the monitor in a generally horizontal configuration.

11. The task light assembly according to claim 8 wherein the support is integrally formed with a body of a computer monitor.

12. The task light assembly according to claim 1 wherein the support comprises a generally horizontal surface suspended above the work surface.

13. The task light assembly according to claim 1 wherein the support comprises a generally vertical surface suspended above the work surface.

14. The task light assembly according to claim 1 wherein the support comprises a generally vertically-extending arm supported on the work surface by a base.

15. The task light assembly according to claim 1 wherein the base is weighted for maintaining support of the light head during extended lateral movement of the light head relative to the base.

16. The task light assembly according to claim 1 wherein the support comprises a clamp for mounting the support and attached adapter to a workplace item.

17. The task light assembly according to claim 1 wherein the adapter comprises an elongated sleeve having an external portion mounted to the support, and the light head further comprises a mounting arm that is received within the sleeve for slidable movement with respect to the sleeve.

18. The task light assembly according to claim 17 and further comprising a power cord operably interconnected with the illuminator within the light head, and the mounting arm comprises an elongated recess for receiving the power cord so that the power cord does not impede movement of the mounting arm with respect to the adapter.

19. The task light assembly according to claim 17 wherein at least one of the adapter and the support also has an elongated recess in register with the elongated recess on the mounting arm of the light head so that the power cord can be routed from the light head to the support.

20. The task light assembly according to claim 17 wherein the adapter sleeve is open at each axial end thereof and wherein the mounting arm on the light head can be inserted into either axial end for slidable movement with respect to the sleeve.

21. The task light assembly according to claim 17 wherein the adapter sleeve has an elongated slot extending at least partially along the longitudinal length thereof, whereby a mounting arm can be laterally inserted into the elongated slot for mounting the mounting arm of the light head for slidable movement with respect to the adapter sleeve.

22. The task light assembly according to claim 21 wherein the adapter sleeve is formed from a generally resilient material, and a lateral width of the elongated slot of the adapter sleeve is less than the width of the mounting arm of the light head, wherein the light head can be snap-fit into the adapter sleeve by laterally forcing the mounting arm of the light head into the longitudinal slot of the adapter sleeve.

23. The task light assembly according to claim 17 wherein the mounting arm of the light head can rotate within the adapter sleeve.

24. The task light assembly according to claim 1 wherein the light head further comprises a pivot mount and wherein the light head can pivot about an axis not parallel to the adapter.

25. The task light assembly according to claim 24 wherein the pivot mount comprises a mounting flange extending from a body of the lamp head and a mounting arm is pivotally coupled to the mounting flange whereby the lamp head can pivot with respect to the mounting arm.

26. The task light assembly according to claim 1 wherein the illuminator is an incandescent light bulb.

27. The task light assembly according to claim 1 wherein the illuminator is an LED-based light source.

28. The task light assembly according to claim 1 and further comprising a power switch for selectively controlling power to the illuminator.

29. The task light assembly according to claim 28 wherein the power switch comprises a touch-sensitive portion on the light head shade and wherein user contact with the light head shade actuates the power switch.

30. The task light assembly according to claim 28 wherein the power switch is mounted on the power cord.

* * * * *